US005333671A

United States Patent [19]

Sera et al.

[11] Patent Number: 5,333,671

[45] Date of Patent: Aug. 2, 1994

[54] THICKNESS ADJUSTABLE MOLD FOR CONTINUOUS CASTING

[75] Inventors: Taizo Sera; Takashi Mitsuhiro; Koichi Ozawa, all of Fukuyama; Yutaka Sakata, Niihama, all of Japan

[73] Assignees: Sumitomo Heavy Industries, Ltd.; NKK Corp., both of Tokyo, Japan

[21] Appl. No.: 83,939

[22] Filed: Jun. 28, 1993

[30] Foreign Application Priority Data

Jun. 29, 1992 [JP] Japan ..... 4-051731

[51] Int. Cl.[5] ..... B22D 11/04

[52] U.S. Cl. ..... 164/436; 164/491

[58] Field of Search ..... 164/436, 491

[56] References Cited

FOREIGN PATENT DOCUMENTS 57-127547 8/1982 Japan ..... 164/436

*Primary Examiner*—Kuang Y. Lin

*Attorney, Agent, or Firm*—Nikaido, Marmelstein, Murray & Oram

[57] ABSTRACT

A center alignment mechanism of a cavity thickness adjustable mold for continuous casting, comprises a guide mechanism which supports a spindle of a carriage device of each narrow face unit of the mold slidably in the wide face-wise directions of wide face units of the mold, and a driving mechanism which moves the guide mechanism in the narrow face-wise directions of the narrow face unit. The guide mechanism comprises a guide block in which the distal end portion of the spindle is slidably supported, a guide groove formed in the wide face units so as to support the guide block slidably in the narrow face-wise directions of the narrow face unit, a bracket in which the proximal end portion of the spindle is slidably supported, and another guide groove formed in the wide face units so as to support the bracket slidably in the narrow face-wise directions of the narrow face unit. The driving mechanism comprises worm jacks provided between the guide block and the fixed wide face unit and between the bracket and the fixed wide face unit, and a driving source of the worm jacks. Thus, there can be provided a cavity thickness variable mold in which narrow face units are not distorted when they are moved, so that wide face copper plates will not be damaged.

2 Claims, 5 Drawing Sheets

THICKNESS ADJUSTABLE MOLD FOR CONTINUOUS CASTING

BACKGROUND OF THE INVENTION

1. Industrial Field of the Invention

The present invention relates to a thickness adjustable mold for continuous casting. More specifically, it relates to an improvement of a thickness adjustable mold in which the mold cavity is selectively defined to have a desired thickness by replacing only narrow face units held between a pair of wide face units.

2. Description of the Prior Art

In a conventional thickness adjustable mold, one of the wide face units constituting the mold is fixed, and the other wide face unit opposite to the fixed one is movably disposed. Narrow face units of a size corresponding to a desired thickness of a cast piece (hereinafter referred to as integral-type narrow face units) are replaceably held between those two wide face units.

With this structure, the whole narrow face units must be detached from the wide face units and replaced by new narrow face units for a desired cavity thickness. Also, various kinds of narrow face units for replacement which have sizes corresponding to predetermined thicknesses of cast pieces must be prepared in advance. Consequently, there are induced a problem that it takes a long time to change the mold size and a problem that expenses for such an equipment are high.

The inventors of the present invention have already proposed a thickness adjustable mold which enables on-line quick replacement of narrow face units (Japanese Patent Application No. 2-418217). As shown in FIG. 4, the basic structure of this adjustable mold comprises a fixed wide face unit 1, a movable wide face unit 2, and a pair of narrow face units 3 and 4 held between these two wide face units 1 and 2. A spindle 5 of a narrow face unit carriage device is connected to each of the narrow face units 3, 4. As shown in FIGS. 5 and 6, the narrow face units 3, 4 are each divided into a base narrow face unit member 11 and a replaceable narrow face unit member 12 (hereinafter referred to as separate-type narrow face units). The above-mentioned spindle 5 is connected to the base narrow face unit member 11, and a wide face copper plate 13 is secured on the replaceable narrow face unit member 12. When the thickness of a cast piece is changed, only the replaceable narrow face unit member 12 is detached by unfastening a bolt 16 and disengaging a hook 15, and a new replaceable narrow face unit member 12 for a desired cavity thickness is attached. In this method, replaceable narrow face unit members 12 for different cavity thicknesses, i.e., having different widths, are merely exchanged, and the base narrow face unit members 11 to which the spindles 5, water supply pipes and so forth are connected need not be detached. Consequently, the cavity thickness changing operation can be carried out relatively easily.

By the way, in the cavity thickness adjustable mold described above, the position of connection of each spindle 5 is unchanged. As shown in FIG. 4, therefore, once the spindle 5 is connected in alignment with the center of a specific narrow face unit 3, the spindle 5 must be connected to a narrow face unit 3 having a different width at an eccentric position.

With the above-described structure, however, when a narrow face unit 3 other than that specific narrow face unit is transferred in the wide face-wise direction, the narrow face unit 3 is distorted owing to eccentricity of the connecting portion, which results in a problem that the distorted narrow face unit 3 damages wide face copper plates 6. In order to solve this problem, the spindle 5 must be always aligned with the center of the narrow face unit 3 irrespective of the width of the narrow face unit 3. However, the structure for this alignment is complicated, and adjustment for such alignment is extremely troublesome.

SUMMARY OF THE INVENTION

Taking these problems into account, it is an object of the present invention to provide an cavity thickness adjustable mold of a simple structure in which narrow face units are not distorted when they are moved, so that wide face copper plates will not be damaged.

According to this invention, there is provided a thickness adjustable mold for continuous casting, comprising a fixed wide face unit, a movable wide face unit which is located in parallel to the fixed wide face unit and designed such that the distance from the fixed wide face unit can be adjusted, a pair of narrow face units each having a width corresponding to the distance between the wide face units, which narrow face units are held between the wide face units and can be wholly replaced, and narrow face unit carriage devices which include spindles attached to the respective narrow face units and move the narrow face units in the wide face-wise directions of the wide face units so as to adjust positions of the narrow face units in the wide face-wise directions, wherein the adjustable mold further includes center alignment mechanisms each comprising a guide mechanism which supports the spindle of the narrow face unit carriage device slidably in the wide face-wise directions and a driving mechanism which moves the guide mechanism in the narrow face-wise directions of the narrow face unit.

Further, in the preferred embodiment of the invention, the guide mechanism comprises a guide block in which one end portion of the spindle on the side of the narrow face unit is slidably supported, a first guide groove formed in the wide face units so as to support the guide block slidably in the narrow face-wise directions of the narrow face unit, a bracket in which the other end portion of the spindle is slidably supported, and a second guide groove formed in the wide face units so as to support the bracket slidably in the narrow face-wise directions of the narrow face unit, and the driving mechanism comprises worm jacks provided between the guide block and the fixed wide face unit and between the bracket and the fixed wide face unit, and a driving source of the worm jacks.

It should be noted that the word, "narrow face unit", used in the scope of claim of this invention denotes a replaceable narrow face unit member in the case of a separate-type narrow face unit which will be described in the preferred embodiment, and that, in the case of an integral-type narrow face unit, this word denotes the whole narrow face unit.

In the present invention, since the spindle of the narrow face unit carriage device can be moved in the narrow face-wise directions of the narrow face unit, the spindle can be connected to the center of any of the narrow face units having different sizes. When the narrow face unit is pressed or retracted by the spindle which is connected to the center of the narrow face unit in this manner, the narrow face unit will not be distorted between the wide face frames, so that wide face copper plates will not be damaged.

DETAILED DESCRIPTION OF THE PREFERRED EMBODIMENT

The preferred embodiment of the present invention will be hereinafter described with reference to the attached drawings.

Figure 1:
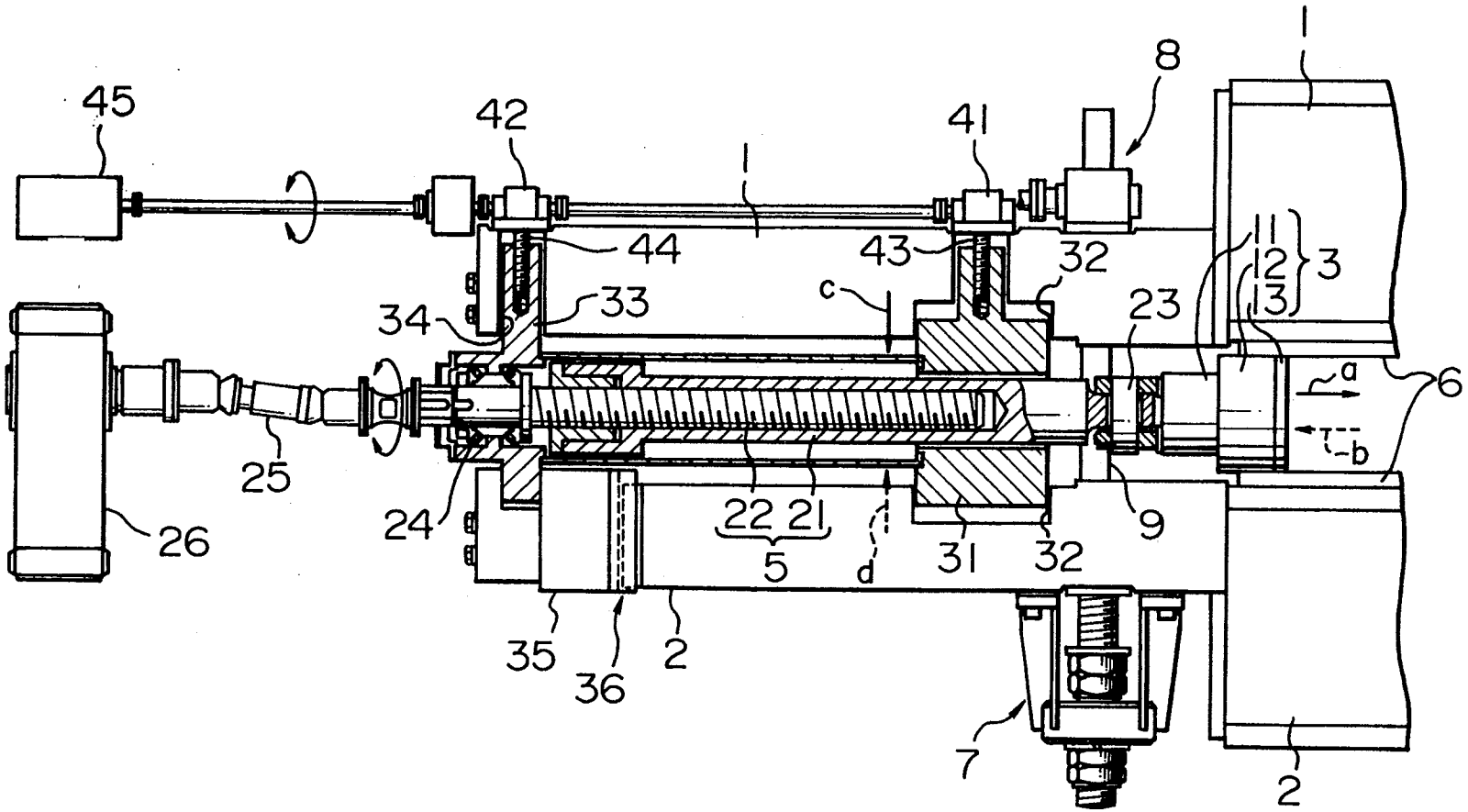
FIG. 1 is a plan view of a center alignment mechanism of a narrow face unit carriage device according to one embodiment of the present invention, showing an essential portion thereof in cross-section.
Figure 2:
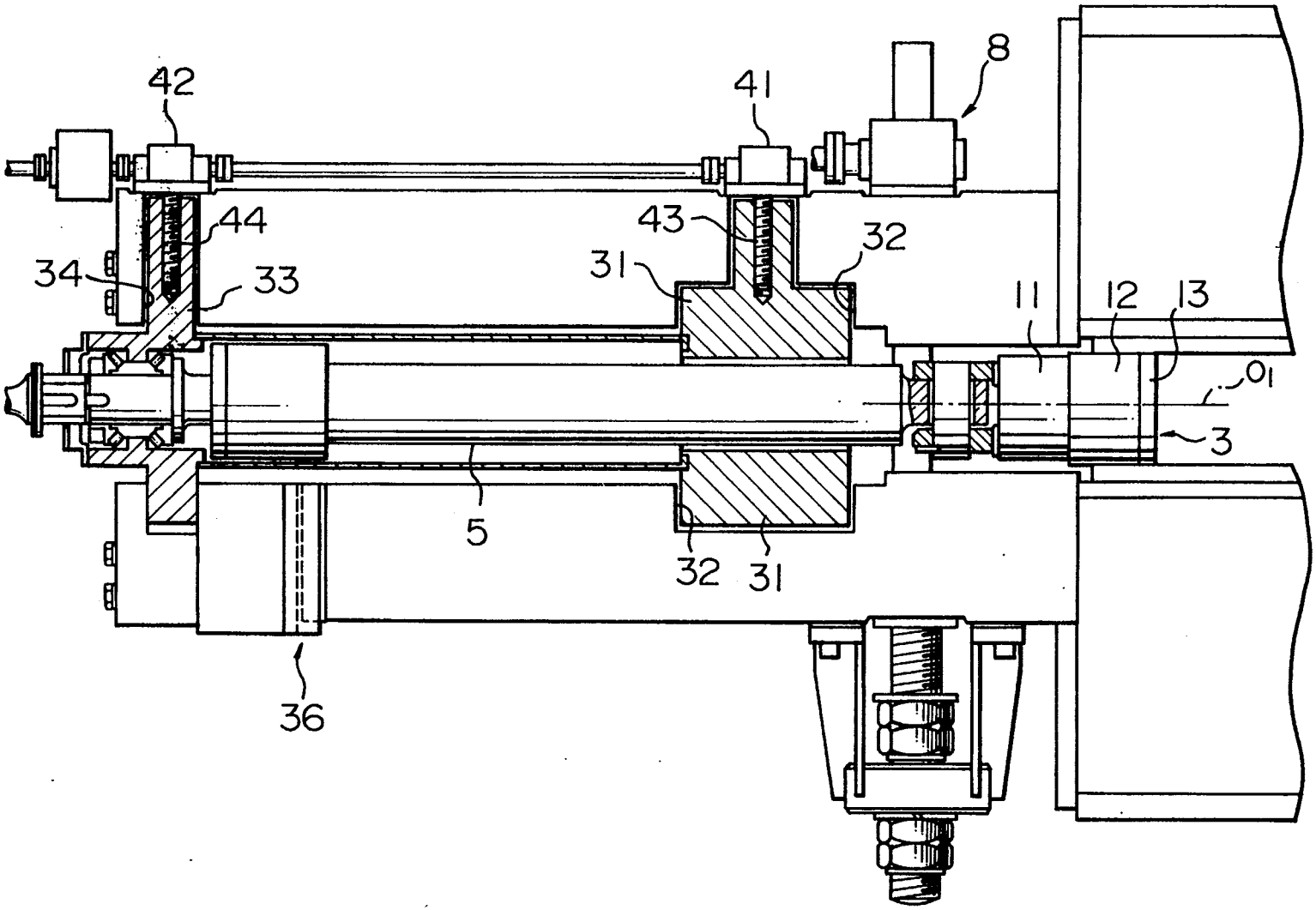
FIG. 2 is a plan view of the center alignment mechanism in a condition where a narrow face unit for a small cavity thickness is mounted, showing an essential portion thereof in cross-section.
Figure 3:
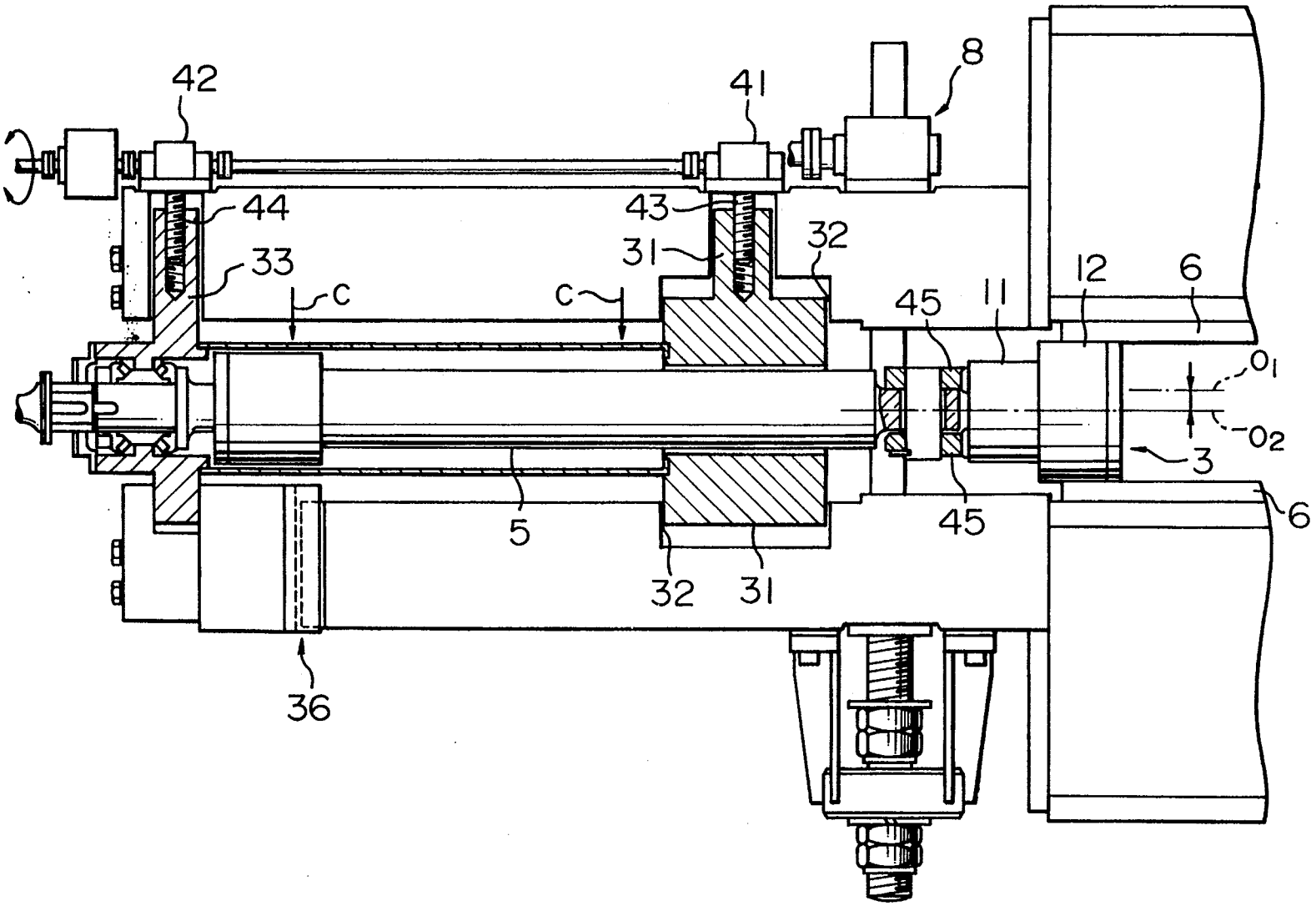
FIG. 3 is a plan view of the center alignment mechanism in a condition where a narrow face unit for a large cavity thickness is mounted, showing an essential portion thereof in cross-section.

FIG. 1 is a plan view of a cavity thickness adjustable mold which includes separate-type narrow face units according to one embodiment of the invention, showing an essential portion thereof in cross-section; FIG. 2 is a plan view showing an essential portion of the mold in a condition where a narrow face unit 3 for a small cavity thickness is mounted; and FIG. 3 is a plan view showing an essential portion of the mold in a condition where a narrow face unit 3 for a large cavity thickness is mounted.

Figure 4:
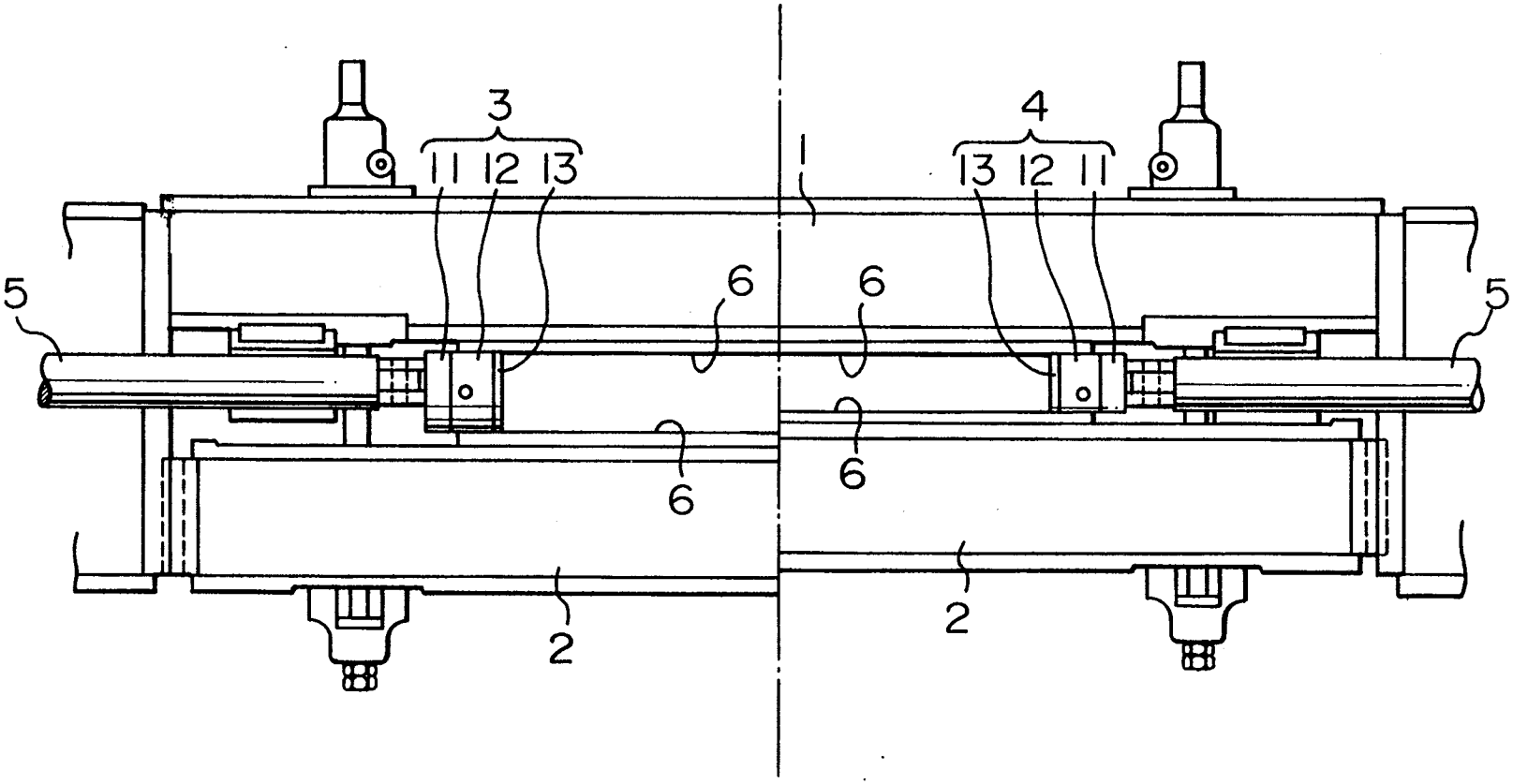
FIG. 4 PRIOR ART
FIG. 4 is a schematic plan view of a conventional cavity thickness adjustable mold.
Figure 5:
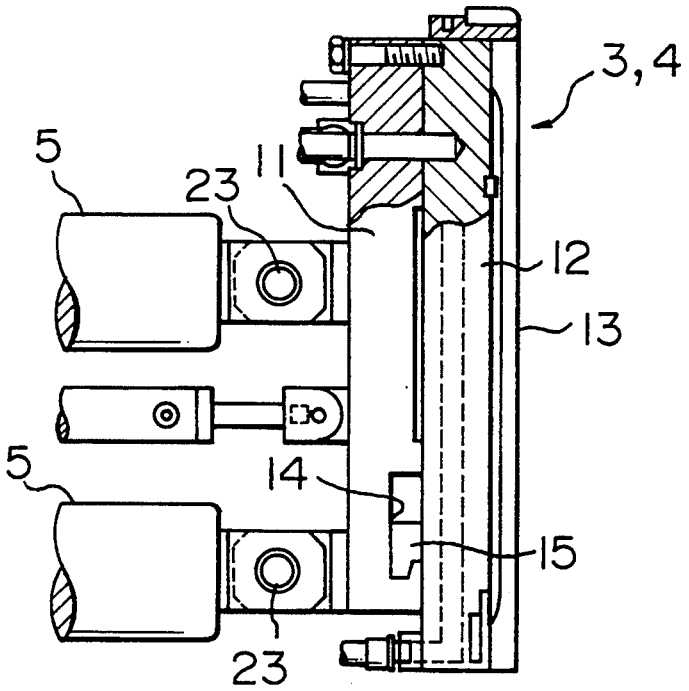
FIG. 5 PRIOR ART
FIG. 5 is a side view showing a narrow face unit 3 shown in FIG. 4.
Figure 6:
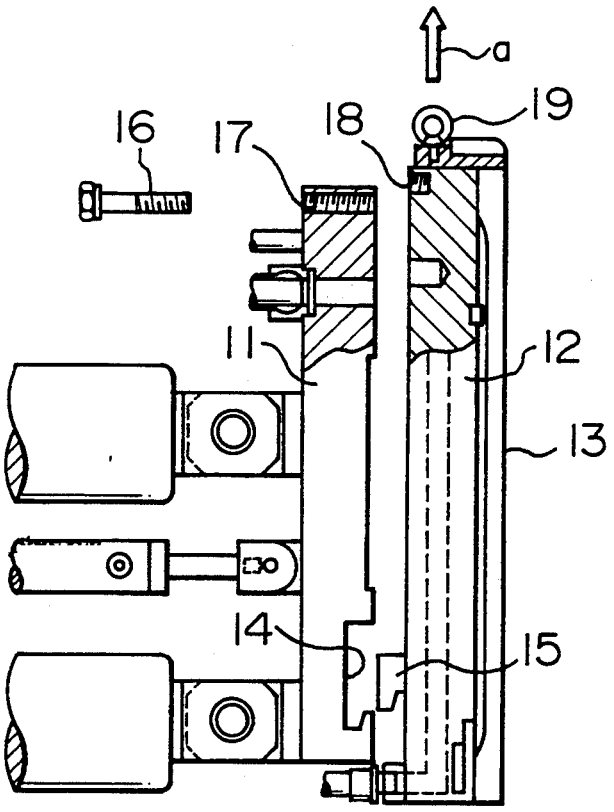
FIG. 6 PRIOR ART
FIG. 6 is a side view illustrative of attaching/detaching operation of a base narrow face unit member 11 and a replaceable narrow face unit member 12 shown in FIG. 5.

As shown in FIG. 1, a fixed wide face unit 1 and a movable wide face unit 2 each includes a wide face copper plate 6 and are connected to each other through tie rods 9. The wide face units i and 2 have the publicly known structure in which the movable wide face unit 2 can be moved with respect to the fixed wide face unit 1 by means of clamping devices 7 and worm jacks 8. A narrow face unit 3 comprises a base narrow face unit member 11, a replaceable narrow face unit member 12 and a narrow face copper plate 13, of which the base narrow face unit member 11 and the replaceable narrow face unit member 12 are detachable. This narrow face unit 3 is substantially the same as the narrow face unit 3 shown in FIGS. 5 and 6 in that a spindle 5 of a narrow face unit carriage device is connected to the base narrow face unit member 11, and that the narrow face copper plate 13 is secured on the replaceable narrow face unit member 12. A narrow face unit on the other side (not shown) has substantially the same structure (see FIG. 4).

The spindle 5 comprises a screw cylinder 21 and a screw rod 22 engaged in the cylinder 21. The distal end of the screw cylinder 21 is connected to the base narrow face unit member 11 through a pin 23 whereas the proximal end of the screw rod 22 is supported by a thrust bearing 24. Further, the end portion of the screw rod 22 is connected to a spindle driving device 26 through a universal joint 25. When the screw rod 22 is rotated by the driving device 26, the screw cylinder 21 is axially advanced or retreated to move the narrow face unit 3 in a direction indicated by an arrow a or b along the wide face units 1 and 2, thereby changing the width of a cast piece. It should be noted that the above-mentioned narrow face unit carriage device has substantially the same structure as the conventionally known one except for an additional guide mechanism, which will be described later.

Center alignment means of the narrow face unit carriage device will now be described in detail.

The distal end portion of the spindle 5 is rotatably supported by a guide block 31 which is slidably supported in guide grooves 32 formed in the fixed wide face unit 1 and the movable wide face unit 2 in such a manner as to load the bottom surfaces of guide grooves 32. The thrust bearing 24 attached to the proximal end portion of the spindle 5 is supported by a bracket 33, and a portion of the bracket 33 on the side of the fixed wide face unit is slidably supported in a guide groove 34 formed in the fixed wide face unit 1 in such a manner as to load the bottom surfaces of guide grooves 34. A connecting frame 35 is connected to a portion of the bracket 33 on the side of the movable wide face unit, and the connecting frame 35 and the movable wide face unit 2 are supported to each other through a slide fitting portion 36 which can be slid.

Screw rods 43 and 44 of worm jacks 41 and 42 are respectively engaged in the guide block 31 and the bracket 33, and the worm jacks 41 and 42 are connected to a driving device 45 such as an electric motor. Consequently, when the worm jacks 41 and 42 are driven by the driving device 45, the guide block 31 is guided by the guide grooves 32, and the bracket 33 is guided by the guide groove 34 and the slide fitting portion 36, so that the guide block 31 and the bracket 33 can be moved in the narrow face-wise direction of the narrow face unit 3, i.e., in the direction of thickness of a cast piece, as indicated by an arrow c or d in FIG. 1.

FIG. 2 is a plan view showing an essential portion of the mold in the case where a replaceable narrow face unit member 12 for a small cavity thickness which has a width of, for example, 220 mm is employed. In the condition illustrated in this figure, the screw rods 43 and 44 of the worm jacks 41 and 42 are fitted deeply in screw holes of the guide block 31 and the bracket 33, respectively, so that the axis of the spindle 5 and the center of the base narrow face unit member 11 are aligned with each other on a center line $O_1$.

FIG. 3 shows a condition of the mold in the case where a replaceable narrow face unit member 12 for a large cavity thickness which has a width of, for example, 300 mm is mounted. In this case, the center of the narrow face unit 3 is located at a position indicated by a center line $O_2$ which is displaced from the above-mentioned center line $O_1$ by 40 mm. In this invention, when the worm jacks 41 and 42 are driven to retract the screw rods 43 and 44 from the screw holes, respectively, the guide block 31 and the bracket 33 are moved in the direction indicated by arrows c, and accordingly, the spindle 5 is moved in the narrow face-wise direction. Therefore, the spindle 5 can be connected to the base narrow face unit member 11 at such a location that the axis of the spindle 5 is aligned with the center line $O_2$ of the new replaceable narrow face unit member 12. When the thickness of a cast piece is decreased, operations in the direction reverse to the above-described one are performed.

In the above description, the separate-type narrow face unit is used. In the case of an integral-type narrow face unit, however, the center of the narrow face unit can be aligned with the axis of the spindle with the center alignment means and likewise pressed or retracted by the spindle so that it will not damage wide face copper plates 6.

According to the present invention, the spindle can be moved in the narrow face-wise direction of the narrow face unit, and consequently, the spindle can be connected to the center of the narrow face unit whatever size it has. Therefore, when the narrow face unit is pressed or retracted by the spindle 5 so as to change the width of a cast piece, the center of the narrow face unit is always pressed or retracted, so that the narrow face unit will not be distorted, and that it will not damage wide face copper plates.

What is claimed is:

1. A thickness adjustable mold for continuous casting, comprising a fixed wide face unit, a movable wide face unit which is located in parallel to said fixed wide face unit and designed such that the distance from said fixed wide face unit can be adjusted, a pair of narrow face units each having a width corresponding to the distance between said wide face units, which narrow face units are held between said wide face units and can be wholly replaced, and narrow face unit carriage devices which include spindles attached to said respective narrow face units and move said narrow face units in the wide face-wise directions of said wide face units so as to adjust positions of the narrow face units in the wide face-wise directions, wherein said adjustable mold further includes center alignment mechanisms each comprising a guide mechanism which supports the spindle of said narrow face unit carriage device slidably in the wide face-wise directions and a driving mechanism which moves said guide mechanism in the narrow face-wise directions of said narrow face unit.

2. A thickness adjustable mold for continuous casting according to claim 1, wherein said guide mechanism comprises a guide block in which one end portion of said spindle on the side of said narrow face unit is slidably supported, a first guide groove formed in said wide face units so as to support said guide block slidably in the narrow face-wise directions of the narrow face unit, a bracket in which the other end portion of said spindle is slidably supported, and a second guide groove formed in said wide face units so as to support said bracket slidably in the narrow face-wise directions of the narrow face unit, and said driving mechanism comprises worm jacks provided between said guide block and said fixed wide face unit and between said bracket and said fixed wide face unit, and a driving source of said worm jacks.

* * * * *